US009917425B1

(12) United States Patent
Umemura et al.

(10) Patent No.: US 9,917,425 B1
(45) Date of Patent: Mar. 13, 2018

(54) SPARK PLUG

(71) Applicant: NGK SPARK PLUG CO., LTD., Nagoya-shi, Aichi (JP)

(72) Inventors: Takafumi Umemura, Nagoyo (JP); Kouji Kamikawa, Nagoya (JP); Tomoki Kawai, Iwakura (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/661,349

(22) Filed: Jul. 27, 2017

(30) Foreign Application Priority Data

Aug. 17, 2016 (JP) ..... 2016-159855

(51) Int. Cl.
*H01T 13/14* (2006.01)
*H01T 13/20* (2006.01)

(52) U.S. Cl.
CPC ..... *H01T 13/14* (2013.01); *H01T 13/20* (2013.01)

(58) Field of Classification Search
CPC ..... H01T 13/14; H01T 13/20; H01T 13/02; H01T 13/32
See application file for complete search history.

(56) References Cited

U.S. PATENT DOCUMENTS 5,347,193 A * 9/1994 Oshima ..... H01T 13/39 313/141
6,091,185 A * 7/2000 Matsubara ..... H01T 13/32 313/118
6,335,587 B1 * 1/2002 Matsubara ..... H01T 13/20 313/123
7,723,906 B2 * 5/2010 Kadowaki ..... H01T 13/38 313/143
8,212,462 B2 * 7/2012 Kato ..... H01T 13/20 313/118

FOREIGN PATENT DOCUMENTS

EP 2461439 A2 6/2012
JP 2012-079417 A 4/2012 ..... H01T 13/20

OTHER PUBLICATIONS

Extended European Search Report issued in corresponding European Patent Application No. 17186649.4, dated Jan. 2, 2018.

* cited by examiner

*Primary Examiner* — Anne Hines
(74) *Attorney, Agent, or Firm* — Kusner & Jaffe

(57) ABSTRACT

A center electrode including an electrode base member having a cylindrical shape with a bottom and a core member embedded in the electrode base member. The core member has a thermal conductivity higher than that of the electrode base member. The center electrode includes a plurality of shoulder portions which each include a diameter reducing portion having a diameter that decreases toward a front end of the spark plug in a direction of an axial line, an outer side surface that extends in the direction of the axial line, and an edge disposed between the diameter reducing portion and the outer side surface. One of the shoulder portions closest to an inner surface of the axial hole has a cutting mark that extends in a circumferential direction over a region from the diameter reducing portion to the edge.

12 Claims, 5 Drawing Sheets

SPARK PLUG

RELATED APPLICATIONS

This application claims the benefit of Japanese Patent Application No. 2016-159855, filed Aug. 17, 2016, the entire contents of which are incorporated herein by reference.

FIELD OF THE INVENTION

The present invention relates to spark plugs, and more particularly, to a self-cleaning spark plug.

BACKGROUND OF THE INVENTION

A typical spark plug includes a metal shell to which a ground electrode is connected and which holds a center electrode in an insulating manner with an insulator interposed therebetween. The spark plug ignites an air-fuel mixture in a combustion chamber of an internal combustion engine by causing a spark discharge between the ground electrode and the center electrode. The spark plug becomes unable to cause a spark discharge when the insulation resistance decreases due to accumulation of carbon, generated by incomplete combustion or the like, on the surface of the insulator and when the applied voltage becomes lower than the required voltage (voltage at which the spark discharge occurs). Accordingly, a self-cleaning spark plug has been proposed (Japanese Unexamined Patent Application Publication No. 2012-79417). In the self-cleaning spark plug, two surfaces having different outer diameters are arranged adjacent to each other in an axial direction of the center electrode. Carbon that has adhered to the insulator is burnt off by a micro discharge starting at the boundary (edge) between the two surfaces.

To ensure sufficient heat resistance, corrosion resistance, and thermal conductivity, the center electrode includes an electrode base member and a core member embedded in the electrode base member. The electrode base member has a cylindrical shape with a bottom, and has high heat resistance and high corrosion resistance. The core member has a thermal conductivity higher than that of the electrode base member. The electrode base member and the core member are integrated with each other by forging. The edge is formed by compressing and thinning a part of a front end portion of the electrode base member by forging.

However, when the edge is formed by thinning a part of the electrode base member by forging, the core member embedded in the electrode base member is also compressed. Therefore, there is a problem that the cross section of the heat-conducting core member is reduced.

SUMMARY OF THE INVENTION

The present invention has been made to address the above-described problem. An advantage of the present invention is a spark plug which includes a heat-conducting core member having a large cross section, and which has high self-cleaning performance.

According to a first aspect of the present invention, there is provided a spark plug that includes an insulator having an axial hole that extends along an axial line, and a center electrode disposed in the axial hole and having a front end that projects beyond a front end surface of the insulator toward the front. A metal shell is disposed outside the insulator in a radial direction. A ground electrode, which is connected to the metal shell, faces the center electrode.

The center electrode includes a plurality of shoulder portions on an outer peripheral surface thereof, each shoulder portion including a diameter reducing portion having a diameter that decreases toward the front end of the spark plug in a direction of the axial line, an outer side surface that extends in the direction of the axial line, and an edge disposed between the diameter reducing portion and the outer side surface. The center electrode includes an electrode base member having a cylindrical shape with a bottom and a core member embedded in the electrode base member. A bottom portion of the electrode base member is disposed at the front end of the center electrode, and the core material has a thermal conductivity higher than that of the electrode base member.

Among the plurality of shoulder portions, the shoulder portion closest to an inner surface of the axial hole has a cutting mark that extends in a circumferential direction over a region from the diameter reducing portion to the edge. Since the edge is formed by cutting the electrode base member, the cross section of the core member is not reduced.

Since the edge, which is formed by a cutting process, is close to the inner surface of the axial hole, carbon that has adhered to the insulator can be burnt off by a micro discharge starting at the edge. Therefore, the heat-conducting core member has a large cross section, and high self-cleaning performance is provided.

According to a second aspect of the present invention, there is provided a spark plug as described above, wherein the edge of the shoulder portion closest to the inner surface of the axial hole is a corner that is not rounded. Therefore, a discharge is easily started at the edge. As a result, not only can the effect of the first aspect be obtained, but the self-cleaning performance can be increased.

According to a third aspect of the present invention, there is provided a spark plug as described above, wherein the edge of the shoulder portion closest to the inner surface of the axial hole is located outside the core member in the radial direction. Since the front end of the core member can be disposed near the front end of the center electrode, not only can the effect of the first or second aspect be obtained, but the heat radiation performance provided by the core member can be increased.

According to a fourth aspect of the present invention, there is provided a spark plug as described above, wherein the core member has an outer diameter of 0.5 mm or more at a position of the edge of the shoulder portion closest to the inner surface of the axial hole in the direction of the axial line. Therefore, not only can the effect of the third aspect be obtained, but the heat radiation performance provided by the core member can be further increased.

According to a fifth aspect of the present invention, there is provided a spark plug as described above, wherein the core member has an outer diameter of 0.8 mm or more at a position 7 mm away from a front end of the core member toward a back end of the spark plug in the direction of the axial line. Therefore, not only can the effect of any of the first to fourth aspects be obtained, but the heat radiation performance provided by the core member can be increased.

DETAILED DESCRIPTION OF THE PREFERRED EMBODIMENTS

Figure 1:
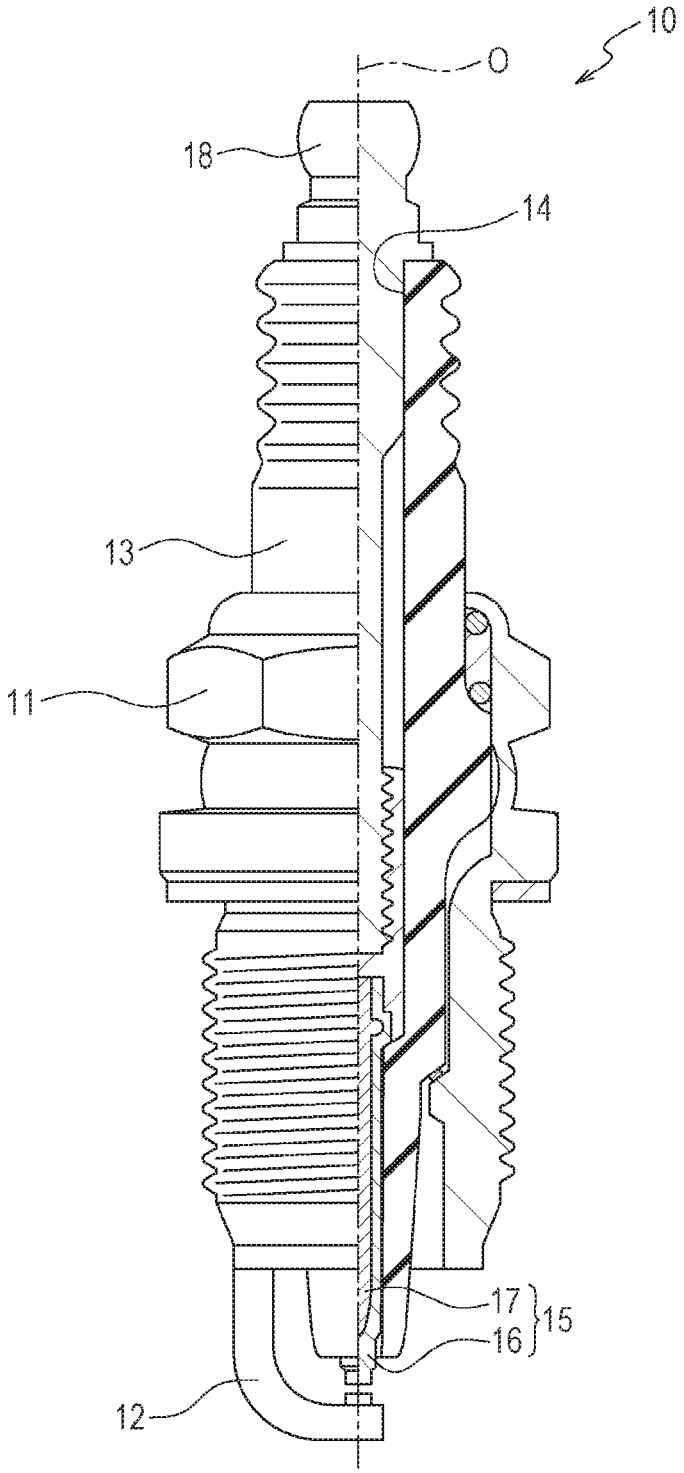
FIG. 1 is a half sectional view of a spark plug according to a first embodiment of the present invention.

Preferred embodiments of the present invention will now be described with reference to the accompanying drawings. FIG. 1 is a half sectional view of a spark plug 10 according to a first embodiment of the present invention with an axial line O at the boundary. The bottom of FIG. 1 is defined as the front of the spark plug 10, and the top of FIG. 1 is defined as the back of the spark plug 10. As illustrated in FIG. 1, the spark plug 10 includes a metal shell 11, an insulator 13, and a center electrode 15.

The metal shell 11 is a substantially cylindrical member that is fixed to an internal combustion engine (not shown), and is made of a conductive metal material (for example, low-carbon steel). The metal shell 11 is electrically connected to a ground electrode 12.

The insulator 13 is a cylindrical member made of a material (for example, alumina) with high mechanical properties and high insulation properties at high temperatures. The insulator 13 has an axial hole 14 that extends therethrough along the axial line O at the center. The insulator 13 is inserted through the metal shell 11, and is fixed to the metal shell 11 at the outer periphery thereof.

The center electrode 15 is a rod-shaped electrode including an electrode base member 16 having a cylindrical shape with a bottom and a core member 17 embedded in the electrode base member 16. The core member 17 is made of a metal (for example, copper) having a thermal conductivity higher than that of the electrode base member 16. The electrode base member 16 is made of a conductive metal material (for example, a nickel-based alloy). The center electrode 15, which is disposed in the axial hole 14 and held by the insulator 13, faces the ground electrode 12 with a spark gap therebetween.

The metal terminal 18 is a rod-shaped member to which a high-voltage cable (not shown) is connected. The front end portion of the metal terminal 18 is inserted in the axial hole 14. The metal terminal 18 is made of a conductive metal material (for example, low-carbon steel), and is electrically connected to the center electrode 15 in the axial hole 14.

Figure 2:
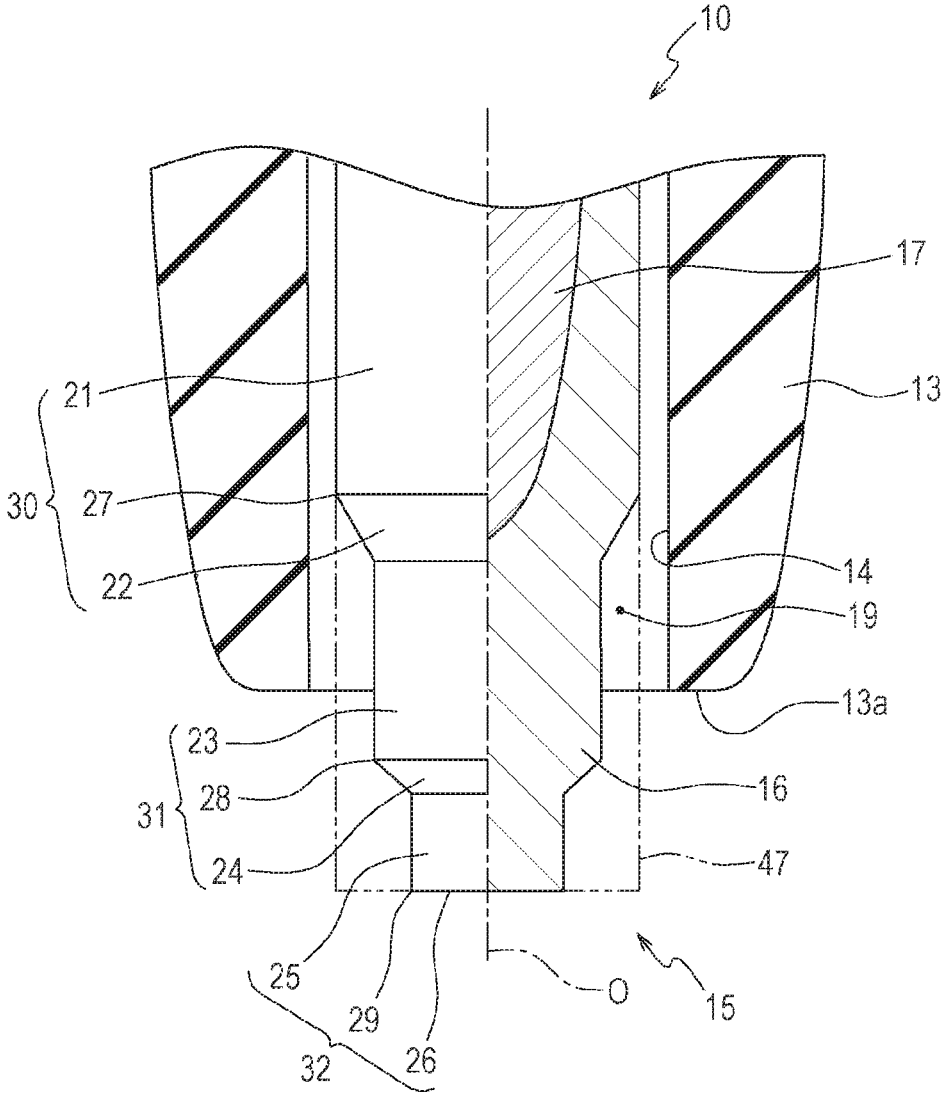
FIG. 2 is a half sectional view of a center electrode.

The structure of a front end portion of the center electrode 15 will be described with reference to FIG. 2. FIG. 2 is a half sectional view of a front end portion of the center electrode 15 with the axial line O at the boundary. In FIG. 2, the insulator 13 is sectioned over the entire area, and back end portions of the insulator 13 and the center electrode 15 in the direction of the axial line O are omitted.

As illustrated in FIG. 2, the center electrode 15 includes a first outer side surface 21 having an outer diameter that is constant in the direction of the axial line O, a first diameter reducing portion 22 having a diameter that decreases toward the front (bottom in FIG. 2), a second outer side surface 23 having an outer diameter that is constant in the direction of the axial line O, a second diameter reducing portion 24 having a diameter that decreases toward the front, a third outer side surface 25 having an outer diameter that is constant in the direction of the axial line O, and a third diameter reducing portion 26 that is a front end surface of the electrode base member 16 and that is perpendicular to the axial line O.

The first outer side surface 21, the first diameter reducing portion 22, the second outer side surface 23, the second diameter reducing portion 24, and the third outer side surface 25 are continuously arranged in that order in the back to front direction of the center electrode 15. The outer diameter of the second outer side surface 23 is smaller than that of the first outer side surface 21. The outer diameter of the third outer side surface 25 is smaller than that of the second outer side surface 23.

The first outer side surface 21 and the first diameter reducing portion 22 are adjacent to each other in the direction of the axial line O with an edge 27, which extends continuously in the circumferential direction, provided therebetween. The edge 27, the first outer side surface 21, and the first diameter reducing portion 22 form a first shoulder portion 30. The second outer side surface 23 and the second diameter reducing portion 24 are adjacent to each other in the direction of the axial line O with an edge 28, which extends continuously in the circumferential direction, provided therebetween. The edge 28, the second outer side surface 23, and the second diameter reducing portion 24 form a second shoulder portion 31. The third outer side surface 25 and the third diameter reducing portion 26 are adjacent to each other with an edge 29, which extends continuously in the circumferential direction, provided therebetween. The edge 29, the third outer side surface 25, and the third diameter reducing portion 26 form a third shoulder portion 32.

Among the shoulder portions 30, 31, and 32, the first shoulder portion 30 is closest to the inner surface of the axial hole 14 in the radial direction, that is, farthest from the axial line O in the radial direction. The edge 27 of the first shoulder portion 30 is closer to the back end (top end in FIG. 2) of the spark plug 10 than the front end surface 13*a* of the insulator 13 in the direction of the axial line O, and the edges 28 and 29 of the shoulder portions 31 and 32 are closer to the front end (bottom end in FIG. 2) of the spark plug 10 than the front end surface 13*a* of the insulator 13 in the direction of the axial line O. The edge 27 is located outside the core member 17 in the radial direction. A gap 19 is formed between the center electrode 15 and the inner surface of the axial hole 14. The size of the gap 19 between the first diameter reducing portion 22 and the inner surface of the axial hole 14 increases from the edge 27 toward the front in the direction of the axial line O.

Figure 3:
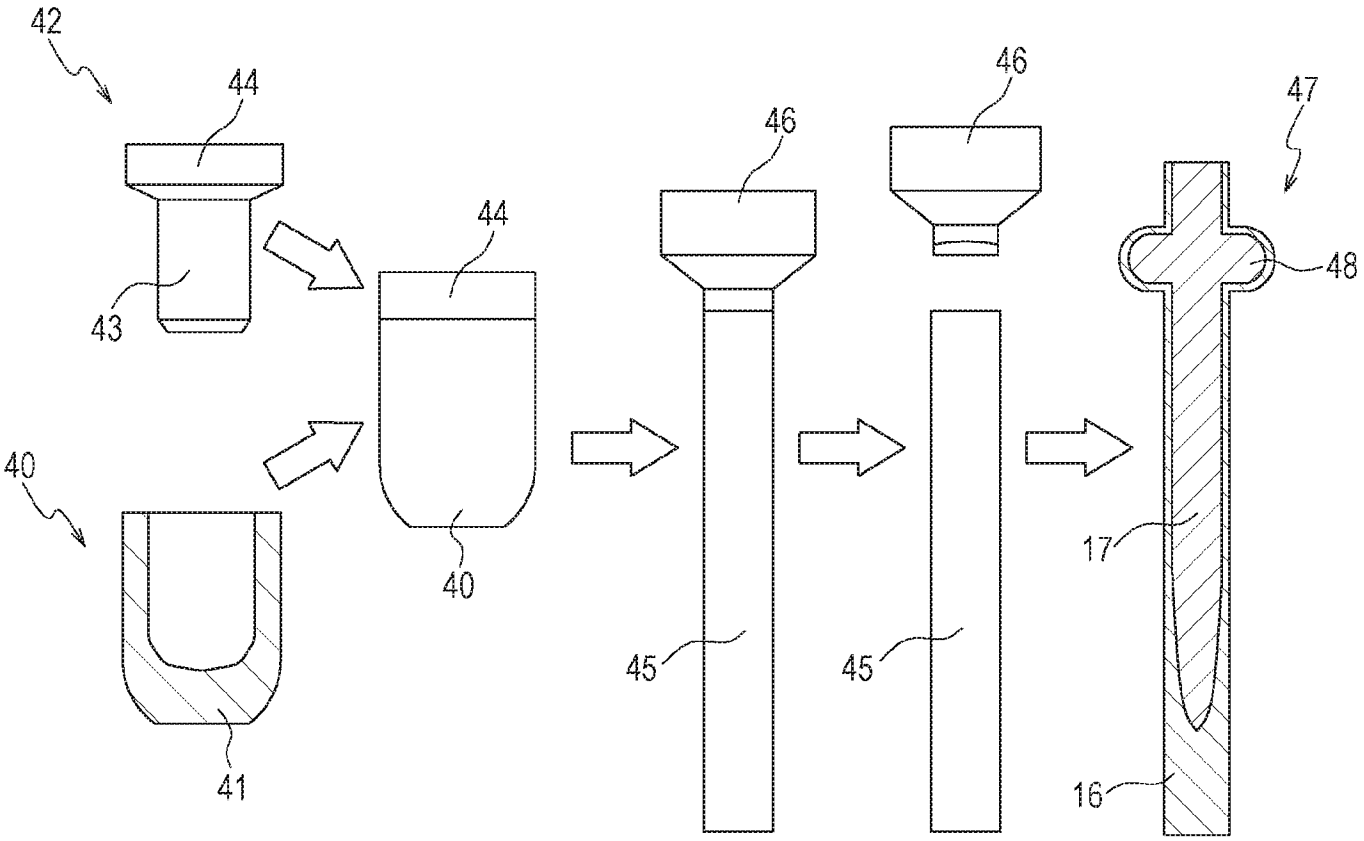
FIG. 3 is a schematic diagram illustrating a manufacturing process of the center electrode.

A method for manufacturing the center electrode 15 will now be described with reference to FIG. 3. FIG. 3 is a schematic diagram illustrating a manufacturing process of the center electrode 15. A cup-shaped molded body 40 including a bottom portion 41 and a columnar metal member 42, which is a material of the core member 17 (see FIG. 1), are prepared. The molded body 40 is a material of the electrode base member 16 (see FIG. 1), and is formed by subjecting a wire to press molding. The metal member 42 includes a columnar portion 43 and a disc portion 44 having an outer diameter greater than that of the columnar portion 43.

The molded body 40 is put on the columnar portion 43 of the metal member 42, and then the molded body 40 and the metal member 42 are subjected to cold forging to form a rod-shaped blank 45. An end portion 46 that is not sufficiently processed is cut off, and then the blank 45 is formed into a thinner blank 47 by cold forging. The blank 47 has a flange portion 48 formed at an end thereof by cold forging.

The flange portion 48 allows the center electrode 15 to be retained on the insulator 13 (see FIG. 1). The blank 47 is formed such that the outer periphery of the core member 17, which is obtained by thinning the metal member 42, is surrounded by and integrated with the electrode base member 16, which is obtained by thinning the molded body 40. The bottom portion 41 of the molded body 40 is formed into a front end portion of the blank 47 at the end opposite to the end at which the flange portion 48 is formed.

A portion of the blank 47 at the end at which the flange portion 48 is formed is fixed to a chuck (not shown), and the blank 47 is rotated around the axial line O. At the same time, an edge of a cutting tool (not shown) is brought into contact with the outer peripheral surface of the front end portion of the blank 47 to cut the electrode base member 16 so that the first diameter reducing portion 22, the second outer side surface 23, the second diameter reducing portion 24, and the third outer side surface 25 are formed on the outer peripheral surface of the electrode base member 16 (see FIG. 2). As a result, a helical cutting mark (tool mark) is formed on the first diameter reducing portion 22, the second outer side surface 23, the second diameter reducing portion 24, and the third outer side surface 25 over a region between the edge 27 and the edge 29 of the center electrode 15. The first outer side surface 21 and the third diameter reducing portion 26 are formed by forging, and therefore have no cutting mark. The edges 27, 28, and 29 are formed as corners that are not rounded by cutting the electrode base member 16.

Referring to FIG. 2 again, the function of the edges 27 and 28 will now be described. In a combustion chamber of the internal combustion engine (not shown), the spark plug 10 becomes unable to cause a spark discharge between the center electrode 15 and the ground electrode 12 (see FIG. 1) if the insulation resistance decreases due to accumulation of carbon, generated by incomplete combustion or the like, on the front end surface 13*a* of the insulator 13 and the inner surface of the axial hole 14 and if the applied voltage becomes lower than the required voltage. However, the spark plug 10 is capable of burning off the carbon that has adhered to the inner surface of the axial hole 14 in the insulator 13 by causing a surface discharge starting at the edge 27, which is located inside the axial hole 14 and closest to the inner surface of the axial hole 14. Owing to this self-cleaning property, the ignition performance of the spark plug 10 can be maintained at a very high level.

The spark plug 10 is also capable of burning off the carbon that has adhered to the front end surface 13*a* of the insulator 13 and the inner surface of the axial hole 14 in a region near the front end surface 13*a* by causing a surface discharge starting at the edge 28. The edge 28 serves to increase the area in which the carbon that has adhered to the insulator 13 can be burnt off. Thus, the self-cleaning performance of the spark plug 10 can be increased.

Since the edges 27 and 28 are formed as corners that are not rounded, the edges 27 and 28 are sharper than in the case where the edges are formed by forging. Since the discharge easily occurs at the sharp edges 27 and 28, the self-cleaning performance of the spark plug 10 is higher than that in the case where the edges are formed by forging.

Figure 4:
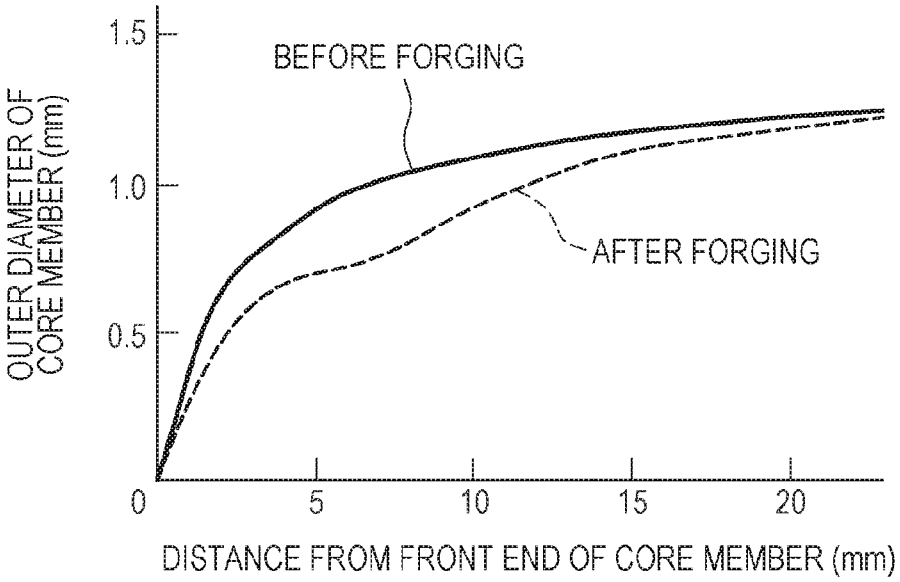
FIG. 4 is a graph showing the relationship between the distance from a front end of a core member and the outer diameter of the core member.

The relationship between the distance from the front end of the core member 17 (see FIG. 2) and the outer diameter of the core member 17 will now be described with reference to FIG. 4. FIG. 4 is a graph showing the relationship between the distance from the front end of the core member 17 and the outer diameter of the core member 17. In FIG. 4, the horizontal axis represents the distance from the front end of the core member 17 in the direction of the axial line O, and the vertical axis represents the outer diameter of the core member 17. The distance from the front end of the core member 17 in the direction of the axial line O and the outer diameter of the core member 17 can be determined by observing a cross section including the axial line O with a microscope or by using an X-ray fluoroscope.

In FIG. 4, the broken line represents the data after the first diameter reducing portion 22, the second outer side surface 23, the second diameter reducing portion 24, and the third outer side surface 25 are formed by forging (hereinafter referred to as "after forging"), and the solid line represents the data of the blank 47 (see FIG. 3) before the first diameter reducing portion 22, the second outer side surface 23, the second diameter reducing portion 24, and the third outer side surface 25 are formed (hereinafter referred to as "before forging"). The outer diameter of the electrode base member 16 of the blank 47 used to obtain the data of FIG. 4 was 1.7 mm.

As illustrated in FIG. 4, the outer diameter of the core member 17 after forging (broken line) is smaller than that before forging (solid line). This is because when the electrode base member 16 is thinned by forging, the core member 17 disposed inside the electrode base member 16 is also thinned. The difference between the outer diameter of the core member 17 after forging and that before forging is significantly large in the region where the distance from the front end of the core member 17 is in the range of 0 to 15 mm. For example, at a position 7 mm away from the front end of the core member 17, the outer diameter of the core member 17 is 1 mm before forging, and is about 0.7 mm after forging. When the outer diameter of the core member 17 is reduced, that is, when the cross section of the core member 17 is reduced by forging, heat conduction through the core member 17 is reduced.

In contrast, the first diameter reducing portion 22, the second outer side surface 23, the second diameter reducing portion 24, and the third outer side surface 25 of the center electrode 15 are formed by cutting. Therefore, the edges 27, 28, and 29 can be formed without reducing the cross section of the core member 17 by cutting only the electrode base member 16. Since the cross section of the heat-conducting core member 17 is not reduced, the heat radiation performance, which is mainly provided by the core member 17, is not reduced. Thus, the heat-conducting core member 17 has a large cross section, and the center electrode 15 provides high self-cleaning performance.

More specifically, the outer diameter of the core member 17 at a position 7 mm away from the front end of the core member 17 in the direction of the axial line O is 0.8 mm or more. Thus, the core member 17 has a large cross section and appropriately radiates (dissipates) heat. Since the amount of heat conducted through the core member 17 is proportional to the cross section of the core member 17, the heat radiation performance provided by the core member 17 can be increased when the outer diameter of the core member 17 at a position 7 mm away from the front end of the core member 17 in the direction of the axial line O is 0.8 mm or more. As a result, the heat resistance of the spark plug 10 can be increased.

This will be further described by referring to FIG. 2 again. As illustrated in FIG. 2, the edge 27 is located outside the core member 17 in the radial direction. The edge 27 is in a projection region of the core member 17 when the core member 17 is projected radially outward with the axial line O at the center. Therefore, the front end of the core member 17 can be disposed near the front end of the center electrode 15. As a result, the heat radiation performance provided by the core member 17 can be increased.

In the spark plug 10, the outer diameter of the core member 17 at the position of the edge 27 in the direction of the axial line O is 0.5 mm or more. Accordingly, the core member 17 has a large cross section at the position of the edge 27. Since the amount of heat conducted through the core member 17 is proportional to the cross section of the core member 17, the core member 17 has high heat radiation performance when the outer diameter of the core member 17 at the position of the edge 27 in the direction of the axial line O is 0.5 mm or more. The cross section of the electrode base member 16 is reduced at the edge 27; therefore, the amount of heat conducted by the electrode base member 16 in the front end portion of the center electrode 15 is reduced at the edge 27. However, since the core member 17 has a large cross section and conducts a large amount of heat, the center electrode 15 has high heat radiation performance. As a result, the spark plug 10 has high heat resistance and self-cleaning performance.

Here, assume that the center electrode 15 is manufactured not by cutting the blank 47 obtained by forging the molded body 40 (see FIG. 3) and the metal member 42, but by changing the shapes of the molded body 40 and the metal member 42 to be subjected to forging so that the center electrode 15 can be manufactured without cutting the blank 47. To ensure that the core member 17 has a sufficient outer diameter in the front end portion of the center electrode 15, it is necessary to reduce the volume of the electrode base member 16 at the front end of the blank 47. For this purpose, the thickness of the bottom portion 41 of the molded body 40, which is a material of the blank 47, needs to be reduced.

However, since the molded body 40 is formed by subjecting a wire to press molding, the thickness of the bottom portion 41 cannot be sufficiently reduced. This is because there is a risk that the bottom portion 41 will break when the molded body 40 is formed by press molding. The bottom portion 41 needs to have a certain thickness to ensure that the molded body 40 has sufficient moldability. Therefore, it is difficult to manufacture the center electrode 15 without cutting the blank 47 by changing the shapes of the molded body 40 and the metal member 42 to be subjected to forging (by reducing the thickness of the bottom portion 41).

In contrast, according to the present embodiment, the center electrode 15 is manufactured by cutting the electrode base member 16 at the front end of the blank 47. Therefore, the first diameter reducing portion 22, the second outer side surface 23, the second diameter reducing portion 24, and the third outer side surface 25 at the front end of the electrode base member 16 can be formed in any shapes while ensuring that the core member 17 disposed inside the electrode base member 16 has a large cross section. As a result, the heat resistance of the spark plug 10 can be increased while maintaining the self-cleaning performance thereof.

A second embodiment will now be described with reference to FIG. 5. In the first embodiment, the edge 27 of the center electrode 15 formed by the cutting process is closer to the back end of the spark plug 10 than the front end surface 13*a* of the insulator 13 in the direction of the axial line O. In contrast, in the second embodiment, an edge 65 of a center electrode 51 formed by a cutting process is at the same position as the front end surface 13*a* of the insulator 13 in the direction of the axial line O. Components that are the same as those described in the first embodiment are denoted by the same reference numerals, and description thereof is omitted.

Figure 5:
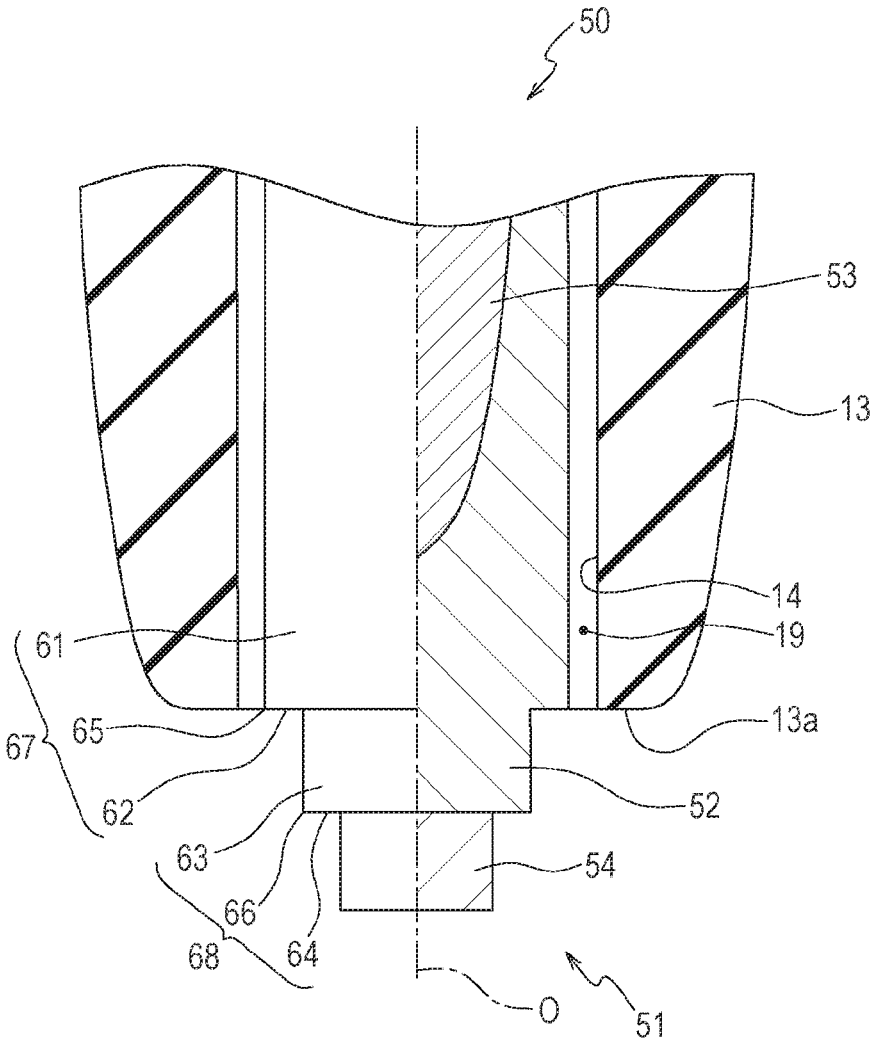
FIG. 5 is a half sectional view of a center electrode of a spark plug according to the second embodiment.

FIG. 5 is a half sectional view of a front end portion of a center electrode 51 of a spark plug 50 according to a second embodiment with the axial line O at the boundary. In FIG. 5, the insulator 13 is sectioned over the entire area, and back end portions of the insulator 13 and the center electrode 51 in the direction of the axial line O are omitted.

As illustrated in FIG. 5, the center electrode 51 includes an electrode base member 52, which has a cylindrical shape with a bottom and which is made of a metal (for example, a nickel-based alloy), and a core member 53 embedded in the electrode base member 52. The core member 53 is made of a metal (for example, copper) having a thermal conductivity higher than that of the electrode base member 52. A columnar tip 54, which is made of a noble metal or an alloy containing a noble metal as the main component, is joined to the front end of the electrode base member 52. The gap 19 is formed between the center electrode 51 and the inner surface of the axial hole 14.

The center electrode 51 includes a first outer side surface 61 having an outer diameter that is constant in the direction of the axial line O, a first diameter reducing portion 62 that is perpendicular to the axial line O and at which the outer diameter of the electrode base member 52 is reduced, a second outer side surface 63 having an outer diameter that is constant in the direction of the axial line O, and a second diameter reducing portion 64 that is a front end surface of the electrode base member 52 and that is perpendicular to the axial line O. The first outer side surface 61, the first diameter reducing portion 62, and the second outer side surface 63 are continuously arranged in that order in the back to front direction of the center electrode 51. The outer diameter of the second outer side surface 63 is smaller than that of the first outer side surface 61.

The first outer side surface 61 and the first diameter reducing portion 62 are adjacent to each other with an edge 65, which extends continuously in the circumferential direction, provided therebetween. The edge 65, the first outer side surface 61, and the first diameter reducing portion 62 form a first shoulder portion 67. The second outer side surface 63 and the second diameter reducing portion 64 are adjacent to each other with an edge 66, which extends continuously in the circumferential direction, provided therebetween. The edge 66, the second outer side surface 63, and the second diameter reducing portion 64 form a second shoulder portion 68.

Among the shoulder portions 67 and 68, the first shoulder portion 67 is closer to the inner surface of the axial hole 14 in the radial direction, that is, farther from the axial line O in the radial direction. The edge 65 of the first shoulder portion 67 is at the same position as the front end surface 13*a* of the insulator 13 in the direction of the axial line O. The edge 66 is closer to the front end (bottom end in FIG. 5) of the spark plug 50 than the front end surface 13*a* of the insulator 13 is in the direction of the axial line O.

The manufacturing method of the center electrode 51 is the same as that of the center electrode 15 described in the first embodiment. The core member 53 is embedded in and integrated with the electrode base member 52 by forging. The outer periphery of the electrode base member 52 is cut by using a cutting tool (not shown) so that the first diameter reducing portion 62 and the second outer side surface 63 are formed. As a result, a helical cutting mark (tool mark) is formed on the electrode base member 52 of the center electrode 51 over a region from the edge 65 to the edge 66. The first outer side surface 61 and the second diameter reducing portion 64 are formed by forging, and therefore have no cutting mark. The edges 65 and 66 are formed as corners that are not rounded by cutting the electrode base member 52.

The spark plug 50 is capable of burning off the carbon that has adhered to the front end surface 13*a* of the insulator 13 by causing a surface discharge starting at the edge 65. Owing to this self-cleaning property, the ignition performance of the spark plug 50 can be maintained at a high level.

Since the edge 65 is formed as a corner that is not rounded, the edge 65 is sharper than in the case where the edge is formed by forging. Since the discharge easily occurs at the sharp edge 65, the self-cleaning performance of the spark plug 50 is higher than that in the case where the edge is formed by forging.

Although embodiments of the present invention have been described, the present invention is not limited to the above-described embodiments in any way, and it can be easily understood that various modifications and changes can be made within the scope of the present invention. For example, the shapes and sizes of the front end portions of the center electrodes 15 and 51 are merely examples, and may be changed as appropriate.

In the above-described first embodiment, the first diameter reducing portion 22 and the second diameter reducing portion 24 are oblique surfaces that are oblique to the axial line O. However, the first diameter reducing portion 22 and the second diameter reducing portion 24 are not limited to this, and may, of course, instead be surfaces that are perpendicular to the axial line O. Similarly, the first diameter reducing portion 62 of the center electrode 51 according to the second embodiment may instead be an oblique surface that is oblique to the axial line O. Thus, each diameter reducing portion may either be an oblique surface that is oblique to the axial line O or a surface that is perpendicular to the axial line O.

In the above-described first embodiment, three shoulder portions are provided. However, the number of shoulder portions is not limited to this, and may be any appropriate number as long as the number is two or more. Similarly, the number of shoulder portions of the center electrode 51 according to the second embodiment may also be any appropriate number.

In the above-described first embodiment, the edge 28 is closer to the front end of the spark plug 10 than the front end surface 13*a* of the insulator 13 in the direction of the axial line O. However, the location of the edge 28 is not limited to this. The edge 28 may instead be closer to the back end of the spark plug 10 than the front end surface 13*a* of the insulator 13 in the direction of the axial line O, or at the same position as the front end surface 13*a* of the insulator 13 in the direction of the axial line O.

In the first embodiment, no tip that is made of a noble metal or an alloy containing a noble metal as the main component is joined to the electrode base member 16. However, the electrode base member 16 is not limited to this, and may instead have the tip joined thereto at the front end, as illustrated in the second embodiment. Similarly, the tip 54 of the center electrode 51 according to the second embodiment may, of course, be omitted.

In the above-described second embodiment, the edge 65 is at the same position as the front end surface 13*a* of the insulator 13 in the direction of the axial line O. However, the location of the edge 65 is not limited to this. The edge 65 may, of course, instead be closer to the back end of the spark plug 50 than the front end surface 13*a* of the insulator 13 in the direction of the axial line O. In this case, the carbon that has adhered to the inner surface of the axial hole 14 can be burnt off by causing a micro discharge starting at the edge 65.

In the above-described embodiments, the cutting mark is not formed on the third diameter reducing portion 26 and the second diameter reducing portion 64 (front end surface) of the electrode base members 16 and 52. In other words, the third diameter reducing portion 26 and the second diameter reducing portion 64 are formed by forging. However, the present invention is not limited to this. When the front ends of the core members 17 and 53 are to be closer to the third diameter reducing portion 26 and the second diameter reducing portion 64 (front end surface) of the electrode base members 16 and 52, the front end surfaces of the electrode base members 16 and 52 may, of course, be cut so that cutting marks are formed on the third diameter reducing portion 26 and the second diameter reducing portion 64. Also in this case, the heat-conducting core members 17 and 53 have large cross sections, and high self-cleaning performance is obtained.

Having described the invention, the following is claimed:

1. A spark plug comprising:

an insulator having an axial hole that extends along an axial line;

a center electrode disposed in the axial hole and having a front end that projects beyond a front end surface of the insulator toward a front end of the spark plug in a direction of the axial line, the center electrode including a plurality of shoulder portions on an outer peripheral surface thereof, each shoulder portion including a diameter reducing portion having a diameter that decreases toward the front end of the spark plug in the direction of the axial line, an outer side surface that extends in the direction of the axial line, and an edge disposed between the diameter reducing portion and the outer side surface, a metal shell disposed outside the insulator in a radial direction; and a ground electrode that is connected to the metal shell and faces the center electrode, wherein the center electrode includes an electrode base member having a cylindrical shape with a bottom and a core member embedded in the electrode base member, the core member having a thermal conductivity higher than a thermal conductivity of the electrode base member, and wherein, among the plurality of shoulder portions, the shoulder portion closest to an inner surface of the axial hole has a cutting mark that extends in a circumferential direction over a region from the diameter reducing portion to the edge.

2. The spark plug according to claim 1, wherein the edge of the shoulder portion closest to the inner surface of the axial hole is a corner that is not rounded.

3. The spark plug according to claim 1, wherein the edge of the shoulder portion closest to the inner surface of the axial hole is located outside the core member in the radial direction.

4. The spark plug according to claim 3, wherein the core member has an outer diameter of 0.5 mm or more at a position of the edge of the shoulder portion closest to the inner surface of the axial hole in the direction of the axial line.

5. The spark plug according to claim 1, wherein the core member has an outer diameter of 0.8 mm or more at a position 7 mm away from a front end of the core member toward a back end of the spark plug in the direction of the axial line.

6. The spark plug according to claim 1, wherein the edge of the shoulder portion closest to the inner surface of the axial hole is a corner that is not rounded, and wherein the edge of the shoulder portion closest to the inner surface of the axial hole is located outside the core member in the radial direction.

7. The spark plug according to claim 6, wherein the core member has an outer diameter of 0.5 mm or more at a position of the edge of the shoulder portion closest to the inner surface of the axial hole in the direction of the axial line.

8. The spark plug according to claim 6, wherein the core member has an outer diameter of 0.8 mm or more at a position 7 mm away from a front end of the core member toward a back end of the spark plug in the direction of the axial line.

9. The spark plug according to claim 7, wherein the core member has an outer diameter of 0.8 mm or more at a position 7 mm away from a front end of the core member toward a back end of the spark plug in the direction of the axial line.

10. The spark plug according to claim 2, wherein the core member has an outer diameter of 0.8 mm or more at a position 7 mm away from a front end of the core member toward a back end of the spark plug in the direction of the axial line.

11. The spark plug according to claim 3, wherein the core member has an outer diameter of 0.8 mm or more at a position 7 mm away from a front end of the core member toward a back end of the spark plug in the direction of the axial line.

12. The spark plug according to claim 4, wherein the core member has an outer diameter of 0.8 mm or more at a position 7 mm away from a front end of the core member toward a back end of the spark plug in the direction of the axial line.

* * * * *